United States Patent [19]

Kanagawa et al.

[11] Patent Number: 4,851,155

[45] Date of Patent: Jul. 25, 1989

[54] SOLIDIFICATION PROCESSING APPARATUS FOR RADIOACTIVE WASTE MATERIALS

[75] Inventors: Yutaka Kanagawa, Handa; Kanjiro Ishizaki, Kumagaya; Mitsuzo Ozawa, Tokyo, all of Japan

[73] Assignees: NGK Insulators, Ltd.; Chichibu Cement Co., Ltd., both of Japan

[21] Appl. No.: 151,196

[22] Filed: Feb. 1, 1988

[30] Foreign Application Priority Data

Feb. 7, 1987 [JP] Japan ..... 62-25565

[51] Int. Cl.[4] ..... G21F 9/00; G21F 9/16; B65B 1/30

[52] U.S. Cl. ..... 252/628; 141/83; 141/95; 252/633; 422/138; 422/159; 422/903; 427/5; 427/212; 427/215; 427/220; 427/221

[58] Field of Search ..... 422/159, 903, 3, 103; 252/626, 631, 633, 628; 141/83, 95; 159/47.3, DIG. 12; 219/360, 509; 366/132, 141, 142, 184; 427/5, 212, 215

[56] References Cited

U.S. PATENT DOCUMENTS

| | | | |
|---|---|---|---|
| 3,966,175 | 6/1976 | Stock et al. | 252/633 |
| 4,061,480 | 12/1977 | Frye et al. | 252/633 |
| 4,119,560 | 10/1978 | Sheeline | 159/DIG. 12 |
| 4,560,501 | 12/1985 | Minami et al. | 252/628 |
| 4,626,414 | 12/1986 | Baatz et al. | 422/159 |
| 4,629,587 | 12/1986 | Monden et al. | 252/628 |
| 4,636,363 | 1/1987 | Kratz et al. | 422/159 |
| 4,681,706 | 7/1987 | Mallory et al. | 252/633 |
| 4,710,318 | 12/1987 | Horiuchi et al. | 252/628 |

*Primary Examiner*—Howard J. Locker
*Attorney, Agent, or Firm*—Arnold, White & Durkee

[57] ABSTRACT

A solidification processing apparatus for radioactive waste materials comprises a tank for a solidifying agent for solidifying the radioactive waste materials, a waste material vessel connected to the tank for the radioactive waste materials, a pouring control unit for controlling pouring of the solidifying agent into the vessel, and a heating and curing chamber for heating the vessel by an indirect heating unit after pouring the solidifying agent onto the waste materials in the vessel to polymerize and set the solidifying agent, thereby solidifying the radioactive waste materials. With this arrangement, the solidifying agent superior in impregnation is poured into a vessel filled with radioactive waste materials, whose poured amount is controlled by the pouring control unit. After pouring the solidifying agent into the vessel, the vessel is heated indirectly by an indirect heating unit in order to avoid deflagration if the solidifying agent is combustible. The solidifying agent is polymerized and set in a relatively short time by promoting the polymerization reaction of the agent to solidify the radioactive waste materials with stability.

8 Claims, 2 Drawing Sheets

SOLIDIFICATION PROCESSING APPARATUS FOR RADIOACTIVE WASTE MATERIALS

BACKGROUND OF THE INVENTION

This invention relates to an apparatus for treating radioactive materials by solidifying them, and more particularly to a solidification processing apparatus for solidifying radioactive waste materials in powdery, granular or indefinite forms in a treating vessel to form stable solidified bodies suitable for keeping, storing or disposing.

Various kinds of radioactive waste materials produced in nuclear power installations such as nuclear power stations are usually stored in the respective installations. Various kinds of solidification processing methods have been proposed or actually used for reducing volume of the waste materials and ensuring their stability in consideration of saving storage spaces as well as safety, transportation and future disposal of the waste materials.

There have been known solidification processing methods for the radioactive waste materials, such as solidifying them with cement or solidifying them by mixing with melted asphalt or plastic material or the like. As an improved method of the above methods, it has been recently proposed to melt radioactive waste materials so as to be solidified in glass or together with melted glass or to solidify radioactive waste materials by cement glass.

In the method of solidifying radioactive waste materials with cement, asphalt or plastic material, however, it is necessary to knead the radioactive waste materials with the solidifying agent such as the cement, asphalt or plastic material after the waste materials have been crushed or pulverized. In the solidification method by the cement glass, moreover, it is necessary to make the radioactive waste materials into pellet forms or to knead the materials with the solidifying agent after crushing or pulverizing the materials. These operations are not preferable as handling operations for the radioactive waste materials, because for example crushers, kneading extruders or pellet forming machines are needed. In the method of solidifying the radioactive waste materials together with glass, the materials are once melted and solidified in glass, or the materials are mixed with melted glass and then solidified together with the glass. Therefore, melting installations required for melting the materials and the glass are very expensive in operation. Moreover, in the case of waste material apt to thermally decompose, an additional installation is needed for treating gases produced in the decomposition.

SUMMARY OF THE INVENTION

It is a principal object of the invention to provide a solidification processing apparatus for radioactive waste materials, which eliminates all the disadvantages of the prior art and which is able to simply solidify radioactive waste materials in a vessel such as a drum can without any pretreatment by pouring a solidifying agent into the materials and heating and curing the materials at low temperatures.

In order to achieve the object the solidification processing apparatus for radioactive waste materials according to the invention comprises a tank for a solidifying agent for solidifying the radioactive waste materials, a waste material vessel connected to said tank for the radioactive waste materials, pouring control means for controlling pouring of said solidifying agent into said vessel, and a heating and curing chamber for heating said vessel by indirect heating means after pouring said solidifying agent onto said waste materials in said vessel to polymerize and set said solidifying agent, thereby solidifying said radioactive waste materials.

With this arrangement, the solidifying agent superior in impregnation is poured into a vessel filled with radioactive waste materials, whose poured amount is controlled by the pouring control means. After completion of pouring the solidifying agent into the vessel, it is heated indirectly by indirect heating means in order to avoid deflagration if the solidifying agent is combustible. The solidifying agent is polymerized and set in a relatively short time by promoting the polymerization reaction of the agent to solidify the radioactive waste materials with stability.

In a preferred embodiment, the pouring control means comprises valve means provided in a pipe connecting the tank and the vessel, and a vacuum deaerating unit connected to the vessel for promoting the pouring of the solidifying agent. With this arrangement, the pouring of the solidfying agent into the vessel is controlled by the valve means, while gases in the vessel are removed by the vacuum deaerating unit to bring the vessel into a negative pressure, thereby enabling the solidifying agent to be poured into the vessel with high efficiency.

The pouring control means preferably comprises impregnation detecting means for controlling the valve means in response to signals from a sensor in the vessel. In this manner, the amount of the solidifying agent impregnated in the radioactive waste materials in the vessel is able to be detected. At a moment when a predetermined amount of the solidifying agent has been impregnated, the valve means is closed to stop the pouring of the solidifying agent.

In another embodiment, the apparatus further comprises a recovery unit for recovering gases exhausted from the tank for the solidifying agent, the vacuum deaerating unit and the heating and curing chamber to recover vaporized solidifying agent in the gases, and a filter for purifying gases after recovering the vaporized solidifying agent. With the arrangement, the vaporized solidifying agent is adsorbed and condensed in the recovery unit for reuse, thereby reducing the running cost and preventing the contamination of environment due to exhausted agent.

In a further embodiment, the indirect heating means comprises control means for controlling polymerization reaction by controlling heating temperature in response to detected temperatures of outer surfaces of the vessel and in the heating and curing chamber. The atmosphere for heating and curing is controlled in a substantially constant condition. Moreover, the condition of the polymerization reaction of the solidifying agent in the vessel is detected from the outside of the apparatus.

The invention will be more fully understood by referring to the following detailed specification and claims taken in connection with the appended drawings.

DESCRIPTION OF THE PREFERRED EMBODIMENT

Figure 1:
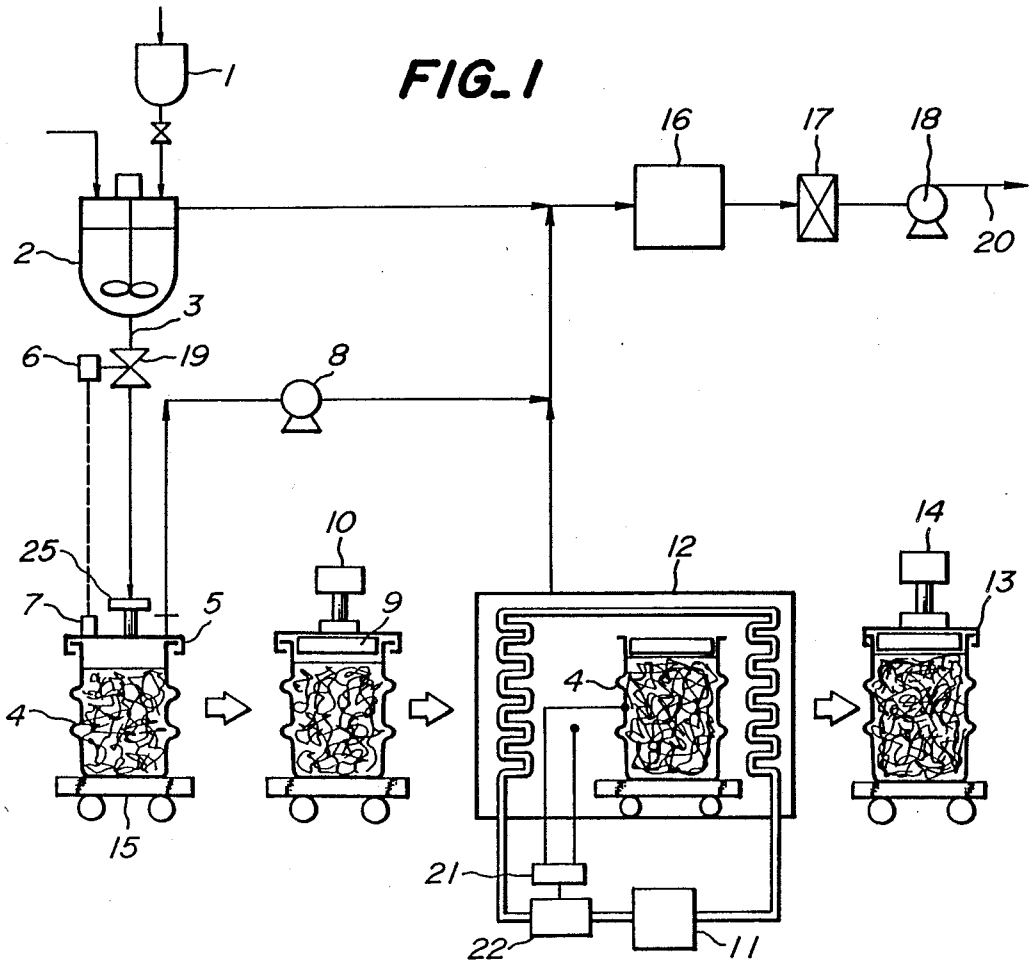
FIG. 1 schematically illustrates the solidification processing apparatus for radioactive waste materials according to the invention.

FIG. 1 schematically illustrates a solidification processing apparatus for radioactive waste materials according to the invention.

The radioactive waste materials treated herein are ashes of burned waste materials, dried powders of concentrated waste liquids, powdery waste materials of used ion-exchange resins, miscellaneous incombustible solid waste materials such as concrete and heat insulators and solid waste material such as metals. As a solidifying agent, for example, a vinyl type monomer may be used which is able to polymerize at low temperatures with ease.

A tank 2 for the solidifying agent comprises a catalyst hopper 1 through which a catalyst is poured into the tank 2 through a catalyst inlet provided in the tank 2. The tank 2 is preferably provided with mixing blades rotatively driven by a motor for mixing the solidifying agent with the catalyst. A solidifying agent supply pipe 3 extends from a bottom of the tank 2 to a waste material vessel 4 and communicates with a cover 5 of the vessel 4 through a flange 25 at a lower end of the pipe 3. Therefore, the solidifying agent in the tank 2 is able to be poured into the waste material vessel 4 through the solidifying agent supply pipe 3. Valve means 19 is provided in the solidifying agent supply pipe 3 to control the amount of the solidifying agent to be poured into the vessel 4 to a predetermined value.

The cover 5 seals the waste material vessel 4 in an air-tight manner. The cover 5 is provided with a vacuum valve connected to a vacuum deaerating unit 8. The vacuum deaerating unit 8 serves to remove gases in the waste material vessel 4 to bring the vessel into a negative pressure condition, thereby promoting the pouring of the agent into the vessel 4. The waste material vessel 4 is arranged on vessel transferring means 15 so as to be transferred to a heating and curing chamber 12 for polymerizing and setting the solidifying agent after the solidifying agent poured into the vessel has impregnated the waste materials in the vessel 4. Particular vessels for treating radioactive waste materials as the vessel 4 are not needed. For example, a drum can provided with concrete layers on its inside may be used.

The waste material vessel 4 may be provided with impregnation detecting means 7 and with pouring control means 6 connected to the impregnation detecting means 7 and the valve means 19. These means control the amount of the solidifying agent to an appropriate value.

Figure 2A:
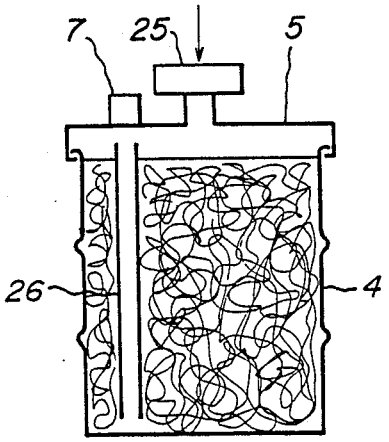
FIGS. 2*a*, 2*b* and 2*c* are schematic sectional views of the various embodiments of the impregnation detecting means used in the apparatus according to the invention.

A communication tube 26 is provided in the waste material vessel 4 vertically extending to a bottom of the vessel 4 as a sensor included in a practical example of the impregnation detecting means 7 (FIG. 2*a*). The waste material is filled in the vessel 4 to a level lower than an upper end of the communication tube and the solidifying agent is poured onto an upper end of the waste materials in the vessel 4. The solidifying agent impregnates the waste materials and arrives at the bottom of the vessel 4. Then the solidifying agent enters the communication tube. Therefore, a level of the solidifying agent in the communication tube is detected by a liquid level indicator, for example, provided in the impregnation detecting means 7.

Figure 2B:
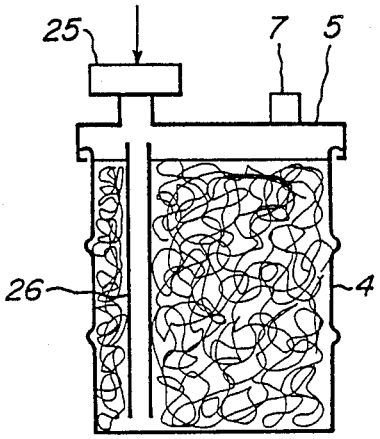
Figure 2C:
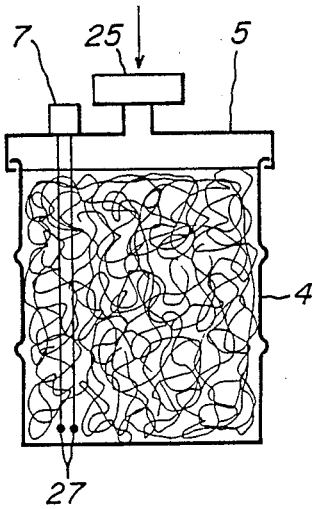

As an alternative, the solidifying agent is poured into the communication tube 26 (FIG. 2*b*). The solidifying agent which has arrived at the bottom of the vessel impregnates from the bottom to the top of the waste materials. A level of the agent on the waste materials is detected by a liquid level indicator provided in the impregnation detecting means 7.

As another alternative embodiment of the impregnation detecting means 7, electrostatic capacity measuring terminals 27 are provided in the vessel 4 so as to be in contact with or in the proximity of the bottom of the vessel. Change in electrostatic capacity of the terminals is detected when the solidifying agent poured from the upper end of the waste material has fully impregnated the materials to their bottom.

In the solidification processing apparatus according to the invention, sufficient impregnation of the solidification agent in the waste materials is required in order to obtain an appropriate solidified body. The impregnation detecting means 7 ensures complete pouring and impregnation of the agent with great certainty.

In order to restrain vaporization of the solidifying agent from the waste material vessel 4 after pouring the agent into the vessel 4, an inner lid 9 may be fitted in the waste material vessel 4, and an inner lid capping unit 10 is mounted thereon. The heating and curing chamber 12 is provided with indirect heating means 11 for heating the vessel 4 together with the waste materials transferred in the chamber 12, thereby setting the solidifying agent and solidifying the waste materials by heating. The indirect heating means may be a heater arranged around the waste material vessel 4. However, a steam heater is preferable in the case using vinyl type monomer (styrene, methyl methacrylate or the like) as the solidifying agent because the steam heater is preferable to prevent deflagration of vaporized combustible monomer and to keep heating temperatures of 50°-70° C., at which the polymerization of the agent is promoted.

The heating and curing chamber 12 is further provided with temperature detecting means 21 connected to the indirect heating means 11 for measuring temperatures on outer surfaces of the waste material vessel 4 and in the heating and curing chamber 12, and with valve means 22 connected to the temperature detecting means 21 for controlling the flow of the steam according to outputs of the temperature detecting means 21.

In order to collect vaporized gases from the solidifying agent such as vinyl type monomer, a monomer recovery unit 16 may be provided, which is adapted to be connected to the solidifying agent tank 2, the vacuum deaerating unit 8 and the heating and curing chamber 12, respectively. The vaporized gases of the vinyl type monomer are adsorbed or condensed by known adsorbing or condensing means such as active carbon in the monomer recovery unit 16, thereby enabling the recovered monomer to be used again. Moreover, there are provided a filter 17 and an exhausting blower 18 adapted to be connected to the monomer recovery unit 16 for filtering exhaust gases after the recovery of the vinyl monomer and exhausting the filtered gases through the blower 18. The vinyl type monomer allows the heating and curing to be effected at low temperature, and is inexpensive in itself and able to be recovered as above described to reduce the operating cost. Therefore, the vinyl type monomer is advantageous as a solidifying agent for this purpose.

The operation of the solidification processing apparatus for radioactive waste materials constructed as above described will be explained hereinafter.

A solidifying agent (vinyl type monomer) and a catalyst are poured into the solidifying agent tank 2 and mixed with each other. Thereafter the mixed agent and catalyst of a suitable amount and a suitable viscosity are introduced by dropping onto the powdery or granular radioactive waste materials in the vessel 4. The dropped agent and catalyst progressively impregnate the powdery or granular radioactive waste materials. The impregnated amount is always monitored by the impregnation detecting means 7 and when the solidifying agent becomes a suitable amount, the valve means 19 is closed by the pouring control means 6 to stop the solidifying agent feeding to the waste materials. In this manner excessive pouring of the solidifying agent is prevented. The waste material vessel 4 enclosing the waste materials impregnated with the vinyl type monomer is covered by the inner lid 9 and the inner lid capping unit 10 and transferred into the heating and curing chamber 12 by means of the vessel transferring means 15. In the chamber 12 the vessel 4 covered by the inner lid 9 is arranged in an atmosphere of 50°-70° C. heated by the steam heating which promotes the polymerization reaction of the vinyl type monomer. The polymerization reaction temperature of the radioactive waste materials in the vessel 4 is measured by the temperature sensor 21 secured to an outer surface of the vessel 4. A substantial completion of the polymerization of the solidifying agent is detected by a peak of the polymerization reaction temperature. The temperature of the atmosphere in the heating and curing chamber 12 is also measured by the temperature sensor 21 and is kept substantially at constant by controlling the valve means 22 by referring to the detected temperature. Therefore, the time required for setting the solidifying agent is shortened, and any excessive heating is avoided. In heating, safety is ensured because of the indirect heating. In order to prevent the pressure in the vessel 4 from rising due to the vaporized gases of the solidifying agent and in order to absorb or condense the vaporized gases of the solidifying agent for reuse, the vaporized gases are extracted from the solidifying agent tank 2, the waste material vessel 4, the heating and curing chamber 12 and the like and fed into the monomer recovery unit 16 in which the monomer is recovered. The remaining gases from which the monomer has been recovered is filtered by the filter 17 to remove noxious gases and then exhausted through the exhaust blower 18. The waste material vessel 4 enclosing the waste materials which have been solidified by heating and setting the solidifying agent in this manner is equipped with a lid 13 and a lid capping unit 14 and stored in a particular location.

An actual solidification process for waste materials with the apparatus will be explained. Using mimic ashes produced by various solid materials instead of radioactive waste materials, the solidification process was carried out by the use of the apparatus according to the invention.

The mimic incineration ash (true specific gravity: 3.0) of 225 Kg was filled to a volume 150 l (bulk specific gravity: 1.5) in a drum can of 200 l (inner capacity: 170 l) having a concrete layer on an inside with the aid of vibration. Styrene monomer added with azobisisobutyronitrile of 2% as a polymerization initiator was used as a solidifying agent. After the solidifying agent had been vacuum deaerated at room temperatures, 80 l of the agent which was more than 75 l of volume of voids in the ash filled in the drum was poured to impregnate the ash. Then the drum was covered by an inner cover made of concrete and heated and cured at 60° C. in a heating and curing chamber to polymerize and setting the agent, thereby obtaining a good solidified body having a specific gravity of 1.9 and a uniaxial compressive strength of 150–200 Kg/cm$^2$.

The solidification processing apparatus for radioactive waste materials according to the invention comprises series of means for pouring, for example, a vinyl type monomer as a solidifying agent superior in impregnation into a vessel filled with the waste materials and thereafter heating and curing the solidifying agent at relatively low temperatures such as 50°-70° C. to polymerize and set the agent and has the following advantages.

(1) Any pretreatments such as classifications and crushing or pulverization of radioactive waste materials are not needed. As a result, the apparatus is simple in construction.

(2) Mixing and kneading operation of radioactive waste materials with the solidifying agent are not needed. Therefore, any kneader and extruder are dispensed with.

(3) As radioactive waste materials are processed by the series of operations of the means of the apparatus, operators are not exposed to radioactive materials.

(4) The apparatus according to the invention is easy in maintenance because of its simplicity in construction.

(5) As the setting of the solidifying agent is promoted by indirect heating, the setting of the solidifying agent or the solidification of the radioactive waste materials is carried out in comparatively short time. Moreover, as the heating is indirect, there is no risk of deflagration even for a combustible solidifying agent, so that the apparatus is superior in safety.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A solidification processing apparatus for radioactive waste materials comprising a tank for a solidifying agent for solidifying the radioactive waste materials, a waste material vessel connected to said tank for the radioactive waste materials, pouring control means for controlling the pouring of said solidifying agent into said vessel, said pouring control means comprising a valve means provided in a pipe connecting said tank and said vessel, said pouring control means further comprising impregnation detecting means for controlling said valve means in response to signals from a sensor in said vessel, a vacuum dearating unit connected to said vessel for promoting the pouring of said solidifying agent and a heating and curing chamber having indirect heating means for heating said vessel after pouring said solidifying agent onto said waste materials in said vessel to polymerize and set said solidifying agent, thereby solidifying said radioactive waste materials.

2. A solidification processing apparatus for radioactive waste materials as set forth in claim 1, wherein said sensor comprises a communication tube extending in said vessel to its bottom and a liquid level indicator for detecting a level of the solidifying agent which has been poured onto said waste materials and penetrated from a bottom of said communication tube, thereby detecting impregnation of the solidifying agent to a bottom of the waste materials.

3. A solidification processing apparatus for radioactive waste materials as set forth in claim 1, wherein said sensor comprises a communication tube extending in said vessel to its bottom and a liquid level indicator for detecting a level of the solidifying agent which has been poured into said communication tube and impregnated from a bottom to a top of said waste materials, thereby detecting impregnation of the solidifying agent throughout the waste materials.

4. A solidification processing apparatus for radioactive waste materials as set forth in claim 1, wherein said sensor comprises electrostatic capacity measuring terminals in the vessel in the proximity of a bottom of said vessel for detecting change in electrostatic capacity, thereby detecting impregnation of the solidification agent which has been poured onto said waste material from a top to a bottom of the materials.

5. A solidification processing apparatus for radioactive waste materials as set forth in claim 1, wherein said apparatus further comprises a recovery unit for recovering gases exhausted from said tank for the solidifying agent, said vacuum deaerating unit and said heating and curing chamber to recover vaporized solidifying agent in said gases, and a filter for purifying gases after recovering the vaporized solidifying agent.

6. A solidification processing apparatus for radioactive waste materials as set forth in claim 1, wherein said indirect heating means comprises control means for controlling polymerization reaction by controlling heating temperature in response to detected temperatures of outer surfaces of the vessel and in said heating and curing chamber.

7. A solidification processing apparatus for radioactive waste materials as set forth in claim 6, wherein said control means comprises a temperature sensor for detecting temperatures of outer surfaces of the vessel and in said heating and curing chamber, and valve means for keeping constant the temperature in the heating and curing chamber in response to detected temperatures.

8. A solidification processing apparatus for radioactive waste materials comprising a tank for a solidifying agent for solidifying the radioactive waste materials, a waste material vessel connected to said tank for the radioactive waste materials, a pipe connecting said tank and said vessel, an impregnation detection sensor positioned in said vessel, pouring control means for controlling pouring of said solidifying agent into said vessel in response to signals from said impregnation detection sensor, a heating and curing chamber having indirect heating means for heating said vessel, said pouring control means comprising a valve means positioned in said pipe.

* * * * *